US007779975B2

(12) United States Patent
Boraas

(10) Patent No.: US 7,779,975 B2
(45) Date of Patent: Aug. 24, 2010

(54) SHOCK ABSORBING AND INDICATING IMPACT BUMPER AND METHOD

(75) Inventor: Michael A. Boraas, Elgin, MN (US)

(73) Assignee: International Business Machines Corporation, Armonk, NY (US)

( * ) Notice: Subject to any disclaimer, the term of this patent is extended or adjusted under 35 U.S.C. 154(b) by 908 days.

(21) Appl. No.: 11/558,081

(22) Filed: Nov. 9, 2006

(65) Prior Publication Data

US 2008/0111386 A1 May 15, 2008

(51) Int. Cl.
*F16F 7/12* (2006.01)

(52) U.S. Cl. ..... 188/377; 267/293; 361/679.34; 361/679.36

(58) Field of Classification Search ..... 188/377, 188/371–376; 267/292, 293; 293/133, 134, 293/136; 361/679.34, 679.35, 679.36
See application file for complete search history.

(56) References Cited

U.S. PATENT DOCUMENTS 4,812,932 A * 3/1989 Hishinuma et al. ..... 360/97.01
5,875,875 A * 3/1999 Knotts ..... 188/374
6,657,858 B2 * 12/2003 Rothschild ..... 361/679.33
7,377,577 B2 * 5/2008 Carroll et al. ..... 296/187.03

* cited by examiner

*Primary Examiner*—Pam Rodriguez
(74) *Attorney, Agent, or Firm*—Cantor Colburn, LLP

(57) ABSTRACT

Disclosed herein is a shock absorbing and indicating bumper. The bumper includes, a spherical shaped body with a surface mountable to a corner of a device to which shock is to be absorbed. The bumper includes a crushable conical member engaged with a conical recess of the spherical shaped body, the crushable conical member having a hole therethrough from the vertex to the center of the base, and a shell with a substantially hollow semispherical shape slidably engaged with a surface of the spherical shaped body. The bumper further includes a rigid shaft with a first end fixedly attached to a central portion of the hollowed side of the shell and a second end pivotally engaged with the spherical shaped body at substantially the center of the spherical shaped body, the shaft extending through the hole in the crushable member and aligned thereby.

6 Claims, 4 Drawing Sheets

SHOCK ABSORBING AND INDICATING IMPACT BUMPER AND METHOD

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates to absorbing shock due to impact, and particularly to using a crushable member to absorb the shock.

2. Description of Background

It is common to mount elastomeric bumpers on the edges and corners of devices, such as electronic devices and shipping packages, for example, to absorb the shock of impacts that may occur while they are handled. The resilient nature of elastomeric bumpers, however, tends to redirect the energy instead of absorbing the energy of an impact. In some instances the device being protected would benefit from a more energy absorptive arrangement as opposed to merely energy redirection. One example of an arrangement that absorbs energy is the crumple zone. These have been developed primarily with respect to automobiles; however, they are effective at absorbing the energy of an impact regardless of the application. The effectiveness of a crumple zone is due, in part, to the absorption of energy during the crumpling, or deformation, of the material from which the crumple zone is constructed. Larger crumple zones, that is crumple zones with more length between a point of impact and the portion of the device that is to be protected from the impact, are more effective than smaller crumple zones, all things being equal.

This relationship of crumple zone size to effectiveness makes it difficult to mount an effective crumple zone on a laptop computer, for example, without adding significant size to the laptop computer for the crumple zone components themselves. An effective crumple zone with minimal size would, therefore, be desirable in the art.

SUMMARY OF THE INVENTION

The shortcomings of the prior art are overcome and additional advantages are provided through the provision of an apparatus that relates to a shock absorbing and indicating bumper. The apparatus includes, a spherical shaped body with a surface mountable to a corner of a device to which shock is to be absorbed. The apparatus also includes a crushable conical member engaged with a conical recess of the spherical shaped body, the crushable conical member having a hole therethrough from the vertex to the center of the base, and a shell with a substantially hollow semispherical shape slidably engaged with a surface of the spherical shaped body. The apparatus further includes a rigid shaft with a first end fixedly attached to a central portion of the hollowed side of the shell and a second end pivotally engaged with the spherical shaped body at substantially the center of the spherical shaped body, the shaft extending through the hole in the crushable member and aligned thereby.

Further disclosed herein is a method that relates to absorbing and indicating shock. The method includes, receiving an impact and transferring some of the impact load to a rotational component, thereby rotationally displacing a first member relative to a second member. The method further includes crushing a crushable material with the displacement of the first member relative to the second member, absorbing at least some of the impact with the crushable material, and exposing a portion of the second member in response to the displacement of the first member relative to the second member.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved a solution, which absorbs impact loads, and records that an impact load has occurred.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
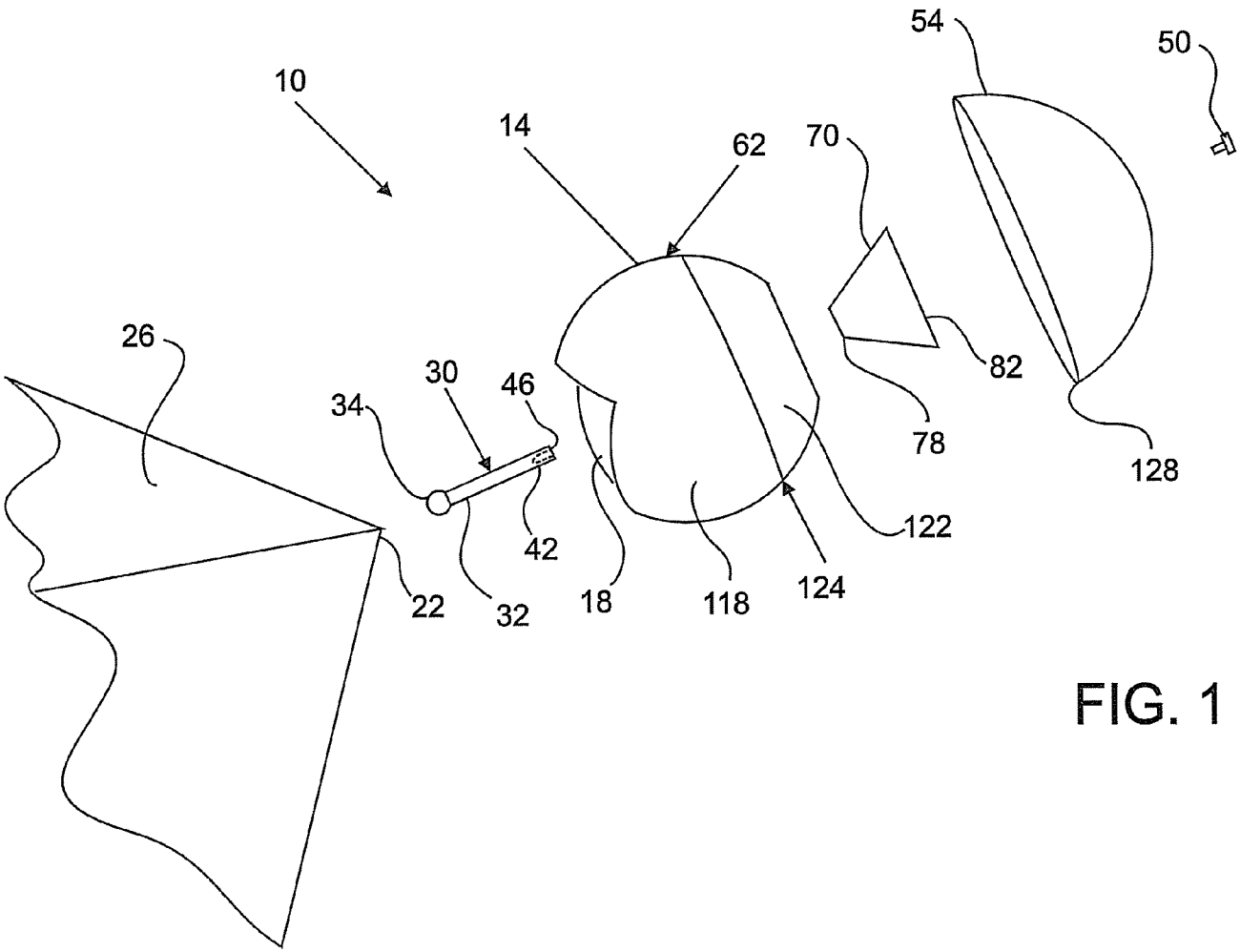
FIG. 1 depicts an exploded view of a bumper disclosed herein.
Figure 2:
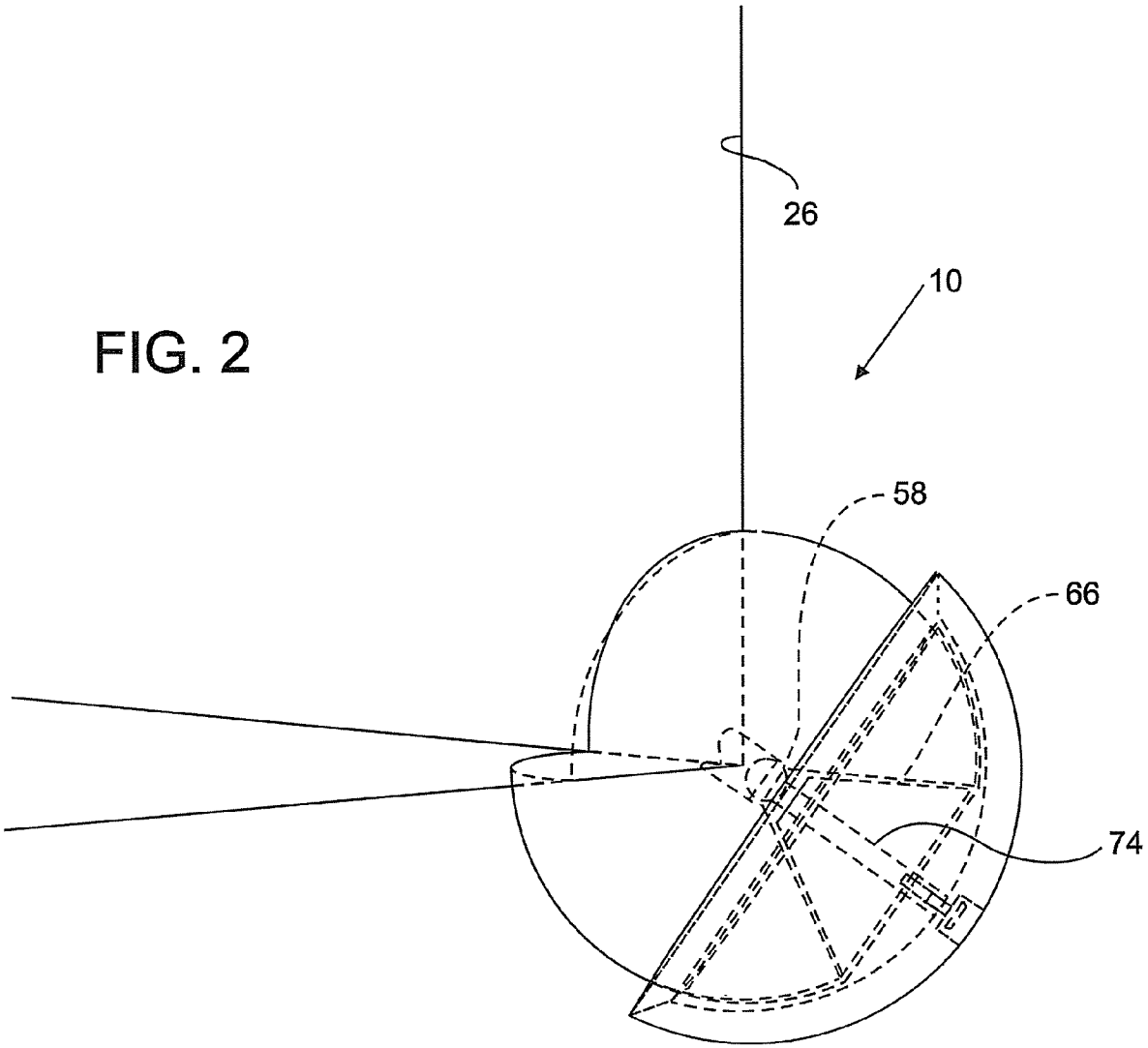
FIG. 2 depicts a perspective view of the bumper in FIG. 1 attached to a device.

Referring to FIGS. 1 and 2 an embodiment of a bumper disclosed herein is shown generally at 10. A spherical shaped body 14 has a recess 18 formed therein that is complementary in shape to a corner 22 of a device 26 to which the bumper 10 is attached. The body 14 depicted herein is attached to the device 26 by adhesive, however, alternate methods of attachment, such as screws of other mechanical attachment means, for example, may be employed. The body 14 may be made of any material capable of receiving a shock due to impact of the device 26 against other hard items, such as a concrete floor, for example, without sustaining significant damage. The body 14 forms the central portion of the bumper 10 to which other components are attached as will be described below.

The body 14 has a rigid shaft 30 pivotally engaged therewith. The rigid shaft 30 has a rod portion 32 and a first end 34 with a spherical shape. The shaft 30 further comprises a second end 42 having a tapped hole 46. Tapped hole 46 is threadably receptive of a screw 50. The screw 50 fixedly attaches a hollow semispherically shaped shell 54 to the rigid shaft 30. The second end 42 of the shaft 30 is inserted through a hole 58 in the body 14 before being attached to the shell 54 by the screw 50. The hole 58 has a diameter that is smaller than the spherical diameter of the first end 34, thereby preventing the first end 34 from passing therethrough. The length of the shaft 30 and the body 14 are sized such that the first end 34 is positioned substantially at the volumetric center of the spherical body 14. The hollow shell 54 fits to an outer spherical surface 62, of the body 14, such that it is slidably engaged with the surface 62.

Through the construction just described, the screw 50 attaches the shell 54 to the shaft 30, thereby locking the body 14 therebetween, such that the shell 54 and the shaft 30 can rotate relative to the body 14. The body 14 also includes a conical recess 66 that extends symmetrically about the hole 58 from a center of the body 14 to the surface 62. A crushable conical member 70 complementarily engages with the conical recess 66. The conical member 70 includes a hole 74 that extends from the vertex 78 to the base 82 of the conical member 70. The hole 74 is receptive of the rod portion 32 of the shaft 30. The conical member 70 thereby centers the shaft 30 and the shell 54 about the conical recess 66.

Figure 3:
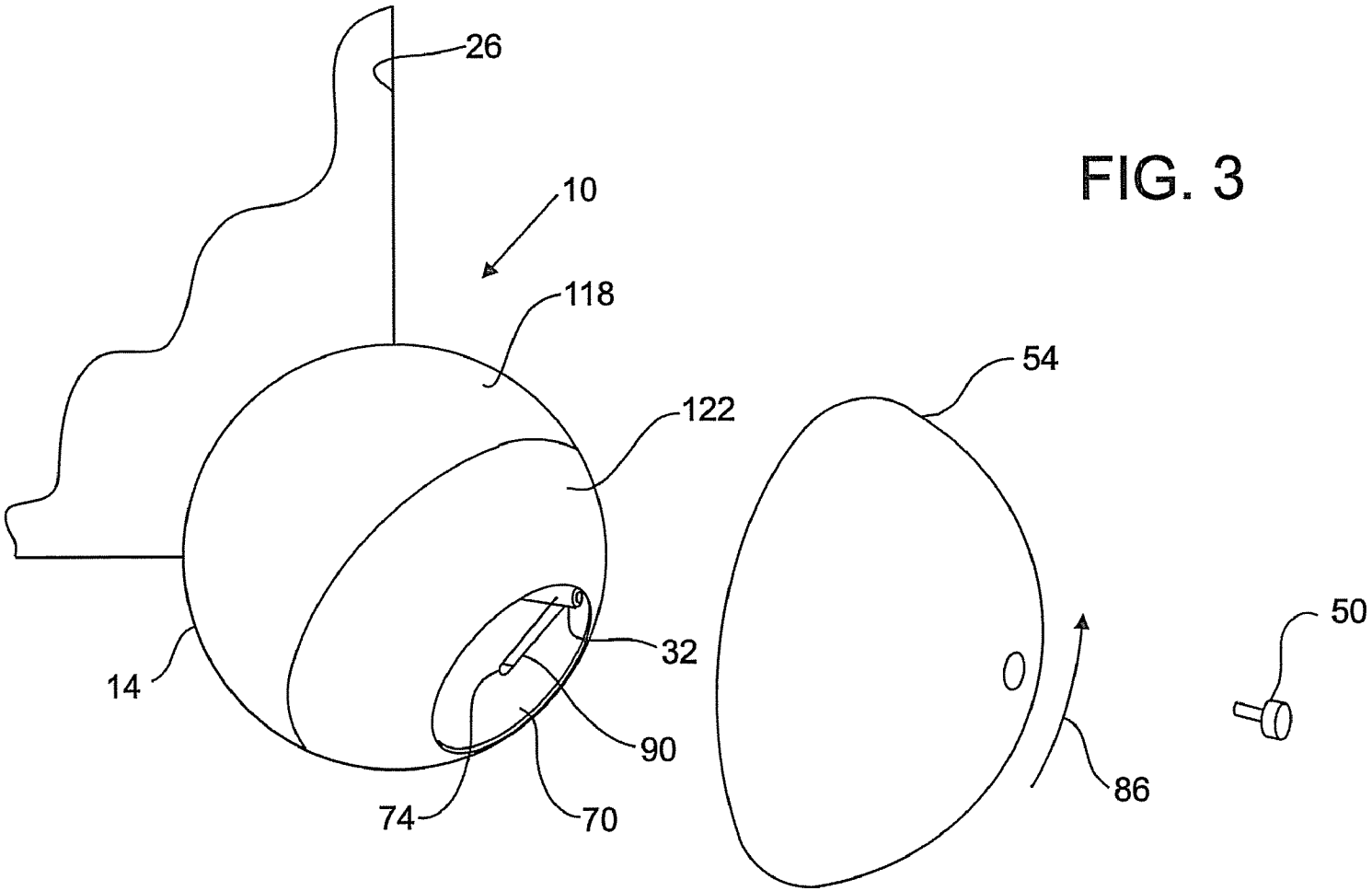
FIG. 3 depicts a perspective view of the bumper of FIG. 1 with the shell and screw exploded away from the body of the bumper.

Referring now to FIG. 3, the conical member 70 is fabricated from a material that is crushable, such as, polystyrene plastic foam, for example. The crushable nature of the conical member 70 enables the rod portion 32 of the shaft 30 to crush through the conical member 70 if adequate force is applied. Thus, if a force is applied to the shell 54 in the direction of arrow 86, for example, a torque is applied to the shaft 30 about the first end 34 causing the rod portion 32 to load against the conical member 70 in the hole 74. If the force is great enough to cause the rod portion 32 to crush the conical member 70, then the rod portion will create a slot 90 in the conical member 70 that traces the motion of the rod portion 32 through the conical member 70. The slot 90 may extend all the way from the hole 74 to the conical recess 66 in the body 14 if the force is great enough for the rod portion 32 to crush the necessary material of the conical member 70. Energy from the shock is absorbed by the crushing of the conical member 70 during the formation of the slot 90.

The absorption of energy, due to the crushing of the conical member 70 during the formation of the slot 90, can be beneficial to the device 26. This benefit is derived from decreasing the magnitude of the deceleration (negative acceleration) that occurs during an impact or shock. For example, if the device 26 were to be dropped onto a concrete floor, the device will accelerate until it reaches an impact velocity ($V_{impact}$) with which the device 26 hits the floor. The final velocity ($V_{final}$), after the impact, will be zero since the concrete floor will not move. Thus the device 26 must decelerate from $V_{impact}$ to $V_{final}$ during the impact. Since deceleration is defined as the change in velocity over time, by increasing the time during which the deceleration takes place, the maximum deceleration that the device encounters will be decreased. Since damage to the device 26 is often related to the maximum deceleration encountered by the device 26; a decrease in the maximum deceleration may decrease the chances of damage to the device 26 occurring from any given impact or shock. The crushable conical member 70 increases the deceleration time by extending the time from the start of the impact until the velocity equals zero.

In order for the crushing of the conical member 70 to absorb energy from the impact at least a portion of the conical member 70 must be crushed. Additionally, since the conical member 70 can only be crushed in a rotational direction of the shell 54 relative to the body 14, the motion of the impact must be, at least partially in a rotational direction. An exemplary embodiment can transfer some motion of the impact from a linear motion to a rotational motion.

Figure 4:
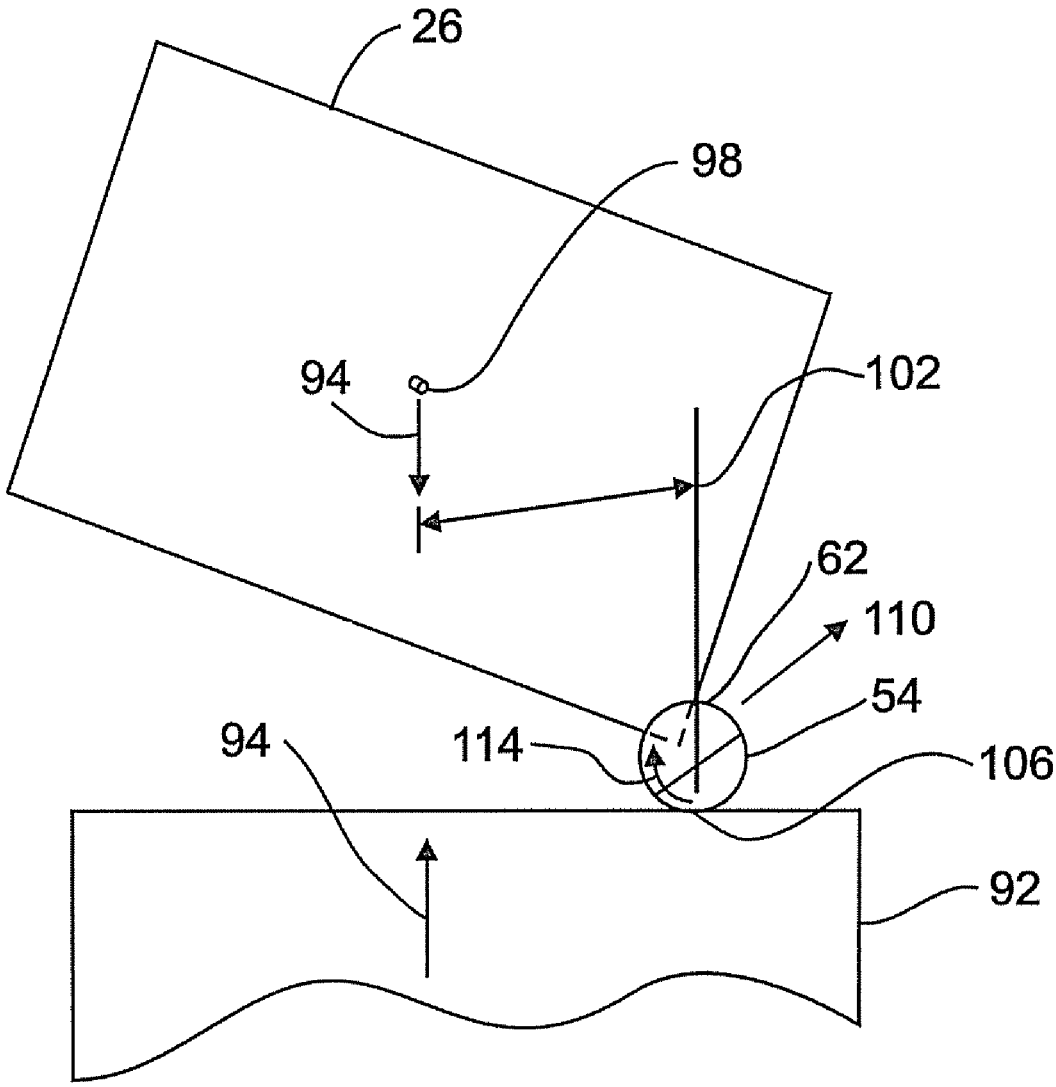
FIG. 4 depicts an elevation view of the bumper of FIG. 1 attached to a device being impacted by an object.

Referring to FIG. 4, the relative motion between the device 26 and an object 92, with which the device is impacting, is shown by arrows 94. The center of gravity 98 of the device 26 has an offset 102, from a point of impact 106 to the center of gravity 98, relative to the arrows 94. This offset 102 results in a rotational motion, of the device 26, in the direction of arrow 110. Friction at the point of impact 106, between the shell 54 and the object 92, results in a rotation of the shell 54 in the direction of arrow 114. It is this rotational motion of the shell 54 relative to the body 14 that causes the rod portion 32, of the shaft 30, to crush the conical member 70 and create the slot 90. And, in so doing, to absorb some of the energy of the impact.

Referring again to FIGS. 1 and 3, an exemplary embodiment includes a first portion of the body 118 with a first color and a second portion of the body 122 with a second color, the second color being different than the first color. For example, the first portion 118 may be black while the second portion 122 may be red. The shell 54 covers the second portion 122, prior to any impact and resulting crush of the conical member 70, such that the transition line 124 between the two portions 118, 122 is substantially in alignment with an edge 128 of the shell 54. Thus, even a small crush of the conical member 70 will result in rotation of the shell 54 relative to the body 14 and exposure of the red color of the second portion 122. The contrast between the red color of the second portion 122 and the black color of the first portion 118 will facilitate observation of the transition line 124, and the second portion 122, which will indicate that an impact has occurred. The impact forces required to crush the conical member 70 to varying depths of the slot 90 can be determined such that the force of an impact can be determined by measurement of the length of the slot 90.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A shock absorbing and indicating bumper, comprising:

a spherical shaped body with a face mountable to a corner of a device to which shock is to be absorbed;

a crushable conical member engaged with a conical recess of the spherical shaped body, the crushable conical member having a hole therethrough from a vertex to the center of a base;

a shell with a substantially hollow semispherical shape slidably engaged with a surface of the spherical shaped body; and a rigid shaft with a first end fixedly attached to a central portion of the hollowed side of the shell and a second end pivotally engaged with the spherical shaped body at substantially the center of the spherical shaped body, the shaft extending through the hole in the crushable member and aligned thereby.

2. The bumper of claim 1, further comprising:

a first portion of the surface of the spherical body having a first color exposed by the shell; and a second portion of the surface of the spherical body having a second color that is different than the first color, the second portion being covered by the shell in response to the conical member being intact and at least a portion of the second portion being exposed in response to the conical member being at least partially crushed.

3. The bumper of claim 2, wherein the second color is red.

4. The bumper of claim 1, wherein the body is attachable to a device by an adhesive.

5. The bumper of claim 1, wherein the shaft pivots relative to the spherical shaped body thereby crushing a portion of the crushable member in response to a torque being applied to the shell relative to the pivotal axis of the shaft.

6. The bumper of claim 1, wherein the crush of the conical member is such that amount of crush of the conical member correlates to an impact load.

* * * * *